US009470452B2

(12) United States Patent
Brown et al.

(10) Patent No.: US 9,470,452 B2
(45) Date of Patent: Oct. 18, 2016

(54) IMPORTED LNG TREATMENT

(75) Inventors: Ross M. Brown, Escondido, CA (US); Irina Dean, El Segundo, CA (US); George B. Narinsky, Boston, MA (US)

(73) Assignee: Cosmodyne, LLC, Seal Beach, CA (US)

( * ) Notice: Subject to any disclaimer, the term of this patent is extended or adjusted under 35 U.S.C. 154(b) by 678 days.

(21) Appl. No.: 12/660,323

(22) Filed: Feb. 25, 2010

(65) Prior Publication Data

US 2010/0154471 A1 Jun. 24, 2010

Related U.S. Application Data

(62) Division of application No. 11/493,133, filed on Jul. 27, 2006, now abandoned.

(51) Int. Cl.

| | |
|---|---|
| ***F25J 3/02*** | (2006.01) |
| *F25J 1/02* | (2006.01) |
| *F01K 9/00* | (2006.01) |

(52) U.S. Cl.

CPC ..... *F25J 3/0214* (2013.01); *F25J 3/0233* (2013.01); *F25J 3/0238* (2013.01); *F01K 9/003* (2013.01); *F25J 1/0255* (2013.01); *F25J 2200/02* (2013.01); *F25J 2200/72* (2013.01); *F25J 2210/04* (2013.01); *F25J 2210/62* (2013.01); *F25J 2215/02* (2013.01); *F25J 2215/60* (2013.01); *F25J 2230/20* (2013.01); *F25J 2235/60* (2013.01); *F25J 2240/02* (2013.01)

(58) Field of Classification Search

CPC .. F25J 3/0214; F25J 2210/62; F25J 2215/02; F25J 1/0255; F25J 3/0233; F25J 3/0238; F25J 2200/02; F25J 2200/72; F25J 2230/20; F25J 2235/60; F25J 2240/02

USPC ..... 62/620, 621; 60/645, 643, 651, 670, 60/672, 671

See application file for complete search history.

(56) References Cited

U.S. PATENT DOCUMENTS

| | | | | |
|---|---|---|---|---|
| 3,837,172 | A | 9/1974 | Markbreiter et al. | |
| 5,114,451 | A | 5/1992 | Rambo et al. | |
| 5,359,856 | A | 11/1994 | Rhoades et al. | |
| 5,678,411 | A * | 10/1997 | Matsumura et al. | 62/50.3 |
| 6,510,706 | B2 * | 1/2003 | Stone et al. | 62/620 |
| 6,564,579 | B1 | 5/2003 | McCartney | |
| 6,604,380 | B1 | 8/2003 | Reddick et al. | |
| 6,907,752 | B2 | 6/2005 | Schroeder et al. | |
| 2005/0218041 | A1 * | 10/2005 | Yoshida et al. | 208/340 |
| 2008/0264100 | A1 * | 10/2008 | Mak et al. | 62/618 |

FOREIGN PATENT DOCUMENTS

WO WO 2006036441 A1 * 4/2006

* cited by examiner

*Primary Examiner* — John F Pettitt
(74) *Attorney, Agent, or Firm* — William W. Haefliger

(57) ABSTRACT

The process of treating imported heating grade source LNG to form engine fuel grade LNG, and/or produce power.

2 Claims, 5 Drawing Sheets

IMPORTED LNG TREATMENT

BACKGROUND OF THE INVENTION

This invention relates generally to treatment of import grade liquefied natural gas (LNG) for uses in addition to formation and distribution of natural gas for commercial purpose. More specifically, it concerns such treatment to form engine fuel grade LNG, and/or to produce commercially distributable gas at elevated pressure, some of the gas used to drive an expansion turbine, to produce power.

Liquefied natural gas (LNG) is typically transported by ship to provide fuel in areas where there is insufficient indigenous natural gas. Once unloaded from the ship, it is stored in large storage tanks and then pumped and heated prior to being injected in gaseous state into a distribution pipeline. The primary end use for the natural gas is as fuel, where the exact chemical composition is of little concern.

There is however, an alternate use for LNG as a motor vehicle fuel where the LNG is carried on the vehicle in liquid form and, after conversion to warm gas, is combusted in an engine. Engines cannot tolerate many of the compounds frequently found in raw LNG, as they cause pre-ignition. High concentrations of many compounds, such as ethane, preclude normal LNG from being used as motor fuel.

It is possible to process LNG (heating grade) into LNG (vehicle engine fuel grade) by removing the undesirable compounds. See in this regard U.S. Pat. No. 6,986,266. One characteristic of conversion methods is the requirement for refrigeration. This raises both the capital cost and operating cost.

SUMMARY OF THE INVENTION

Large LNG receiving and send-out terminals present a unique opportunity to use already available LNG refrigeration, as well as pressurization to produce power. The present invention involves use of the refrigeration of the LNG being pumped and sent out (injected into a pipeline) to provide refrigeration necessary to convert a portion of the stream into a more purified stream of LNG (vehicle grade); and/or to employ the pressurization of the LNG supplied at such terminals, to produce mechanical power.

In a first basic aspect, the invention concerns the process of treating heating grade source LNG to form engine fuel grade LNG, which includes the steps a) distilling a stream of source LNG to form purified distillate, b) providing a heat exchanger/condenser, c) and passing such distillate in heat exchange relation with refrigerated source LNG in the heat exchanger/condenser to condense the distillate thereby forming condensate which constitutes the engine fuel grade LNG.

In a second basic aspect, the invention concern the process of employing imported heating grade source LNG to produce power, which includes the steps a) providing a heat exchanger/condenser, b) providing a vaporizer c) providing an expansion turbine, d) passing a pressurized and refrigerated stream of source LNG through the heat exchanger and then to the vaporizer for conversion to commercially distributable gas at elevated pressure, e) directing some of said gas to flow through the expansion turbine producing turbine output power, and a turbine exhaust stream for return to the process.

As respects the first basic aspect, additional process objectives include:

1. providing a vaporizer and pumping a stream of said heating grade LNG through the heat exchanger, for supply to the vaporizer,
2. operating the vaporizer to receive heating grade source LNG and produce heating grade natural gas for commercial distribution,
3. providing and operating an expansion turbine to which pressurized natural gas from the vaporizer is supplied, and from which expanded natural gas is supplied to one of the following:
   d) a distillation column, wherein said distillation takes place,
   e) said heat exchanger, for condensation and subsequent flow to said source stream LNG,
4. passing a reflux portion of said condensate to the distillation column, at an upper level therein,
5. removing bottoms liquid formed in said column, and subjecting said bottoms to vaporization to produce engine fuel grade LNG,
6. providing a distillation column in which said distilling takes place, and wherein said expanded natural gas produced by the turbine is supplied to a lower level in the column.

As respects the second basic aspect, additional process objective includes:

1. passing the turbine exhaust stream to one of the following
   i) said heat exchanger/condenser for condensation therein and return flow to the source LNG stream,
   ii) a distillation column from which distillate flows to the heat exchanger/condenser,
2. pumping the source LNG, for distribution
3. providing the expansion turbine to include two turbine stages and said heat exchanger/condenser including two stages, turbine exhaust from one turbine stage passing to one heat exchanger/condenser stage, and turbine exhaust from the other turbine stage passing to the other heat exchanger/condenser stage, and wherein a portion of the turbine exhaust from said one turbine stage is passed to the other turbine stage for expansion therein,
4. combining turbine exhaust from one turbine stage, after passing through one heat exchanger/condenser stage, with turbine exhaust from another turbine stage, for passage to the other heat exchanger/condenser stage.

A further object is to use the turbine to drive a pump that pressurizes the source LNG to flow to the heat exchanger and vaporizer units.

These and other objects and advantages of the invention, as well as the details of an illustrative embodiment, will be more fully understood from the following specification and drawings, in which:

DRAWING DESCRIPTION

FIG. 4*a* shows turbine drive of an LNG pump, for pumping LNG to a vaporizer.

DETAILED DESCRIPTION

Figure 1:
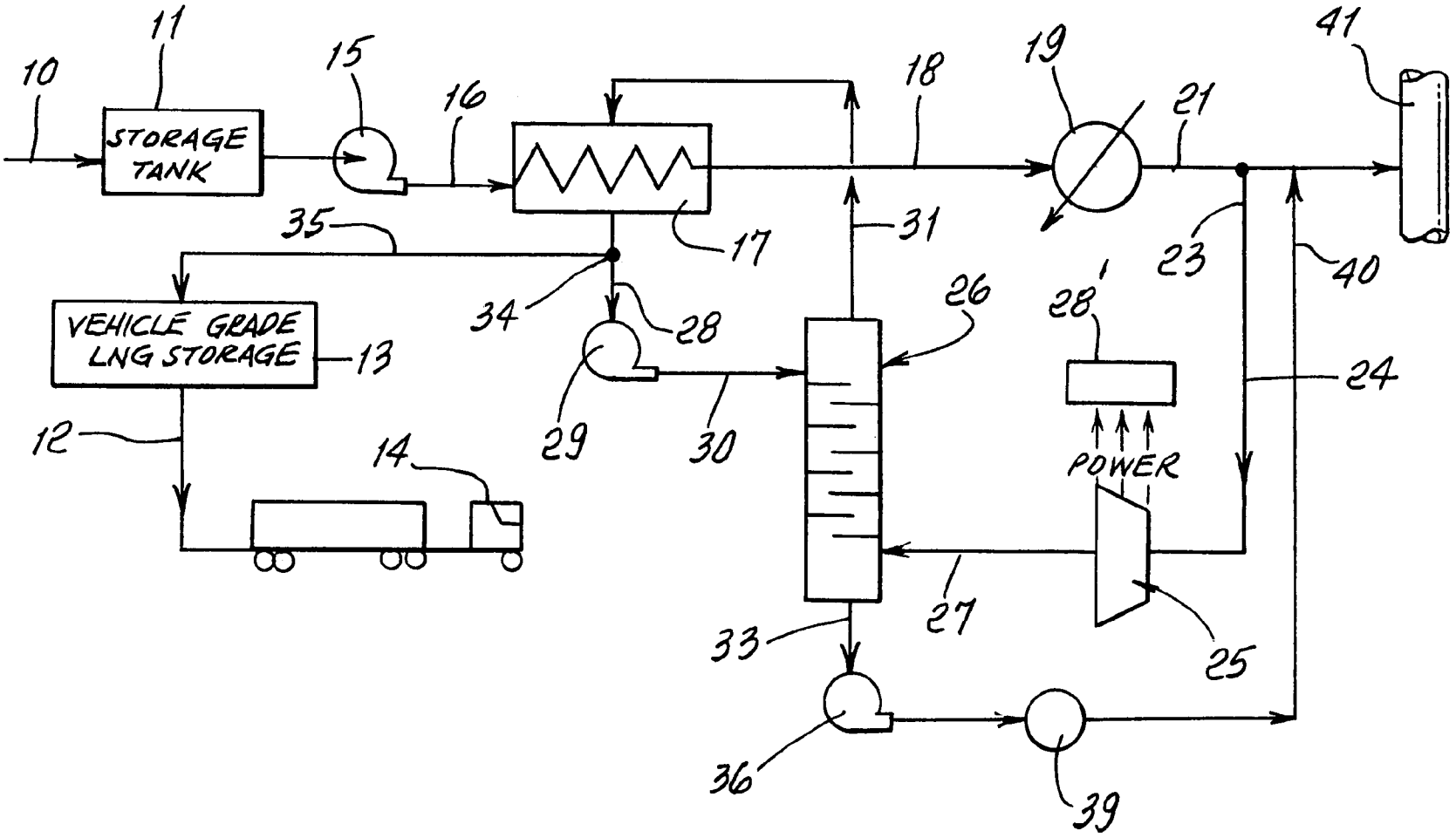
FIG. 1 is a diagram showing one form of the invention.

In FIG. 1, the preferred form of the invention, heating grade source LNG, supplied at 10 as from a ship or transport vessel, is stored at 11, as imported LNG. It is desired that vehicle engine grade LNG be derived from the LNG stored at 11, and supplied for commercial purposes as at 12, as for example from storage at 13. A commercial transport vehicle is shown as for example at 14 receiving the vehicle grade LNG.

The refrigerated heating grade LNG supplied as from storage 11 is pumped at 15 for delivery at 16 to heat exchanger/condenser apparatus 17, from which it flows at 18 to a vaporizer 19. The pump elevates the LNG to pipeline pressure, typically 50 to 100 atmospheres; and the vaporizer operates to heat the cold LNG to warm temperature, typically 10 to 20 degrees Centigrade, for conversion to gas. The gasified LNG is then delivered at 21 to a commercial pipeline 41.

The process utilizes the "cold" containing in the LNG exiting the pump to provide refrigeration to operate a distillation column 26 which will purify the LNG to vehicle grade (typically 99% methane). A by-product of the process is the production of power (typically electric).

The liquid LNG flowing through one side of the exchanger 17 is heated slightly (typically from 115 degK to 120 degK). The other side involves condensing a near pure methane gas stream at a higher than atmospheric pressure (typically 7 to 14 atm). Most of the condensed methane is delivered at 28 to pump 29, and pumped at 30 (or may flow by gravity) to the top of the distillation column 26 as reflux.

A warm slip stream of natural gas (typically at about 10 degrees Centigrade and about 90 atmospheres) is split off at 23, and delivered at 24 to an expansion turbine 25, operating to reduce the gas stream pressure to a level compatible with the operating pressure of distillation column 26. Gas from the turbine is delivered at 27 to a lower level in that column 26. Shaft output power from the turbine may be delivered to an electric generator, as indicated at 28'.

The turbine exhaust gas rises up the column, counter current with the reflux injected at the top. This separates the natural gas into two streams; a near pure methane gas 31 and a heavier liquid product 33 at the column bottom (containing ethane and other heavies). The top product 31 flows to the heat exchanger/condenser described above, where it is condensed. The portion of the condensate not returned to the column as reflux is diverted at 34 and flows at 35 to the vehicle grade LNG tank 13 as product. The column bottom products 33 may be returned by pumping at 36 to pipeline pressure, and vaporized at 39 prior to joining the supply at 40 to the pipeline 41. Alternatively, it may be further processed to a quality that may be used separately (for instance as a feedstock for olefin production).

There is a tradeoff between the maximum amount of vehicle grade LNG that may be extracted and column operating pressure. For typical applications, the maximum yield is about 10% (this keeps the column operating pressure reasonable).

The power generation is beneficial to the economics of the process. The use of the turbine is one form of throttling process, and the same result could be achieved with a throttle valve; but no power is then generated and the yield (percent vehicle grade product to send out gas) will be reduced.

Figure 2:
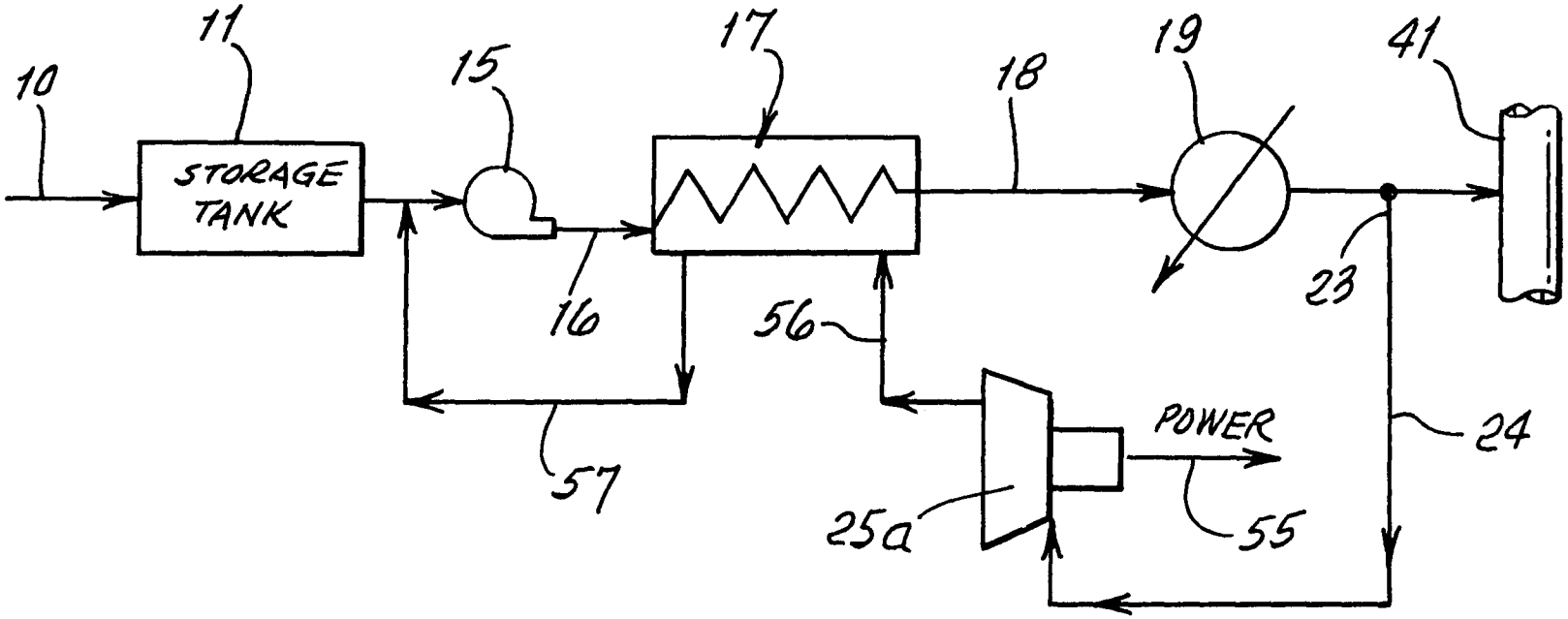
FIG. 2 is a diagram showing another form of the invention.

Referring to FIG. 2, elements the same as in FIG. 1 are given the same identifying numbers. The expansion turbine 25*a* receives slipstream 24, and is driven to produce power, indicated at 55. The exiting gas stream at 56 is returned to the heat exchanger/condenser 17 wherein it is condensed. The condensate exits the exchanger, and flows at 57 to rejoin the original LNG stream (heating grade) to be pumped back to pressure by pump 15. The turbine exhaust pressure may have a wide range of values, limited only by the amount of turbine flow and refrigeration available in the LNG. Again, advantage is taken of the imported LNG refrigeration.

Figure 3:
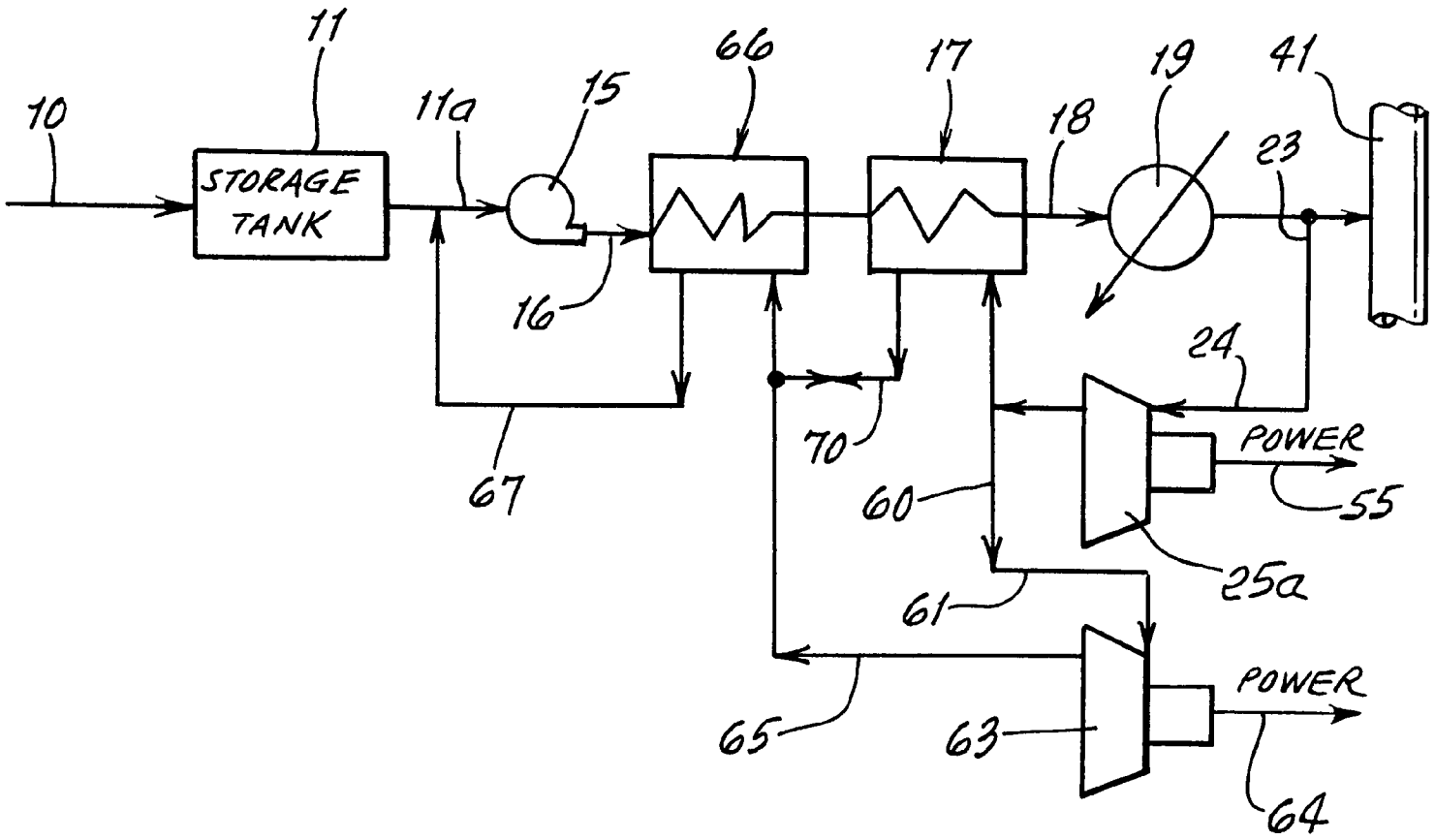
FIG. 3 is a diagram showing yet another form of the invention.

In FIG. 3, some of the exhaust stream 56 is diverted at 60 to flow at 61 to drive a second expansion turbine 63 for producing power at 64. The discharge from that turbine is returned at 65 to a second and lower pressure condenser 66 in series with high pressure condenser 17 as shown. Condensate from 17 is fed at 70 to join stream 65 entering 66, and condensate from 66 is fed at 67 to join stream 11*a* to pump 15. Accordingly, a two-stage LNG expansion is provided, as well as a two stage condensation.

Figure 4:
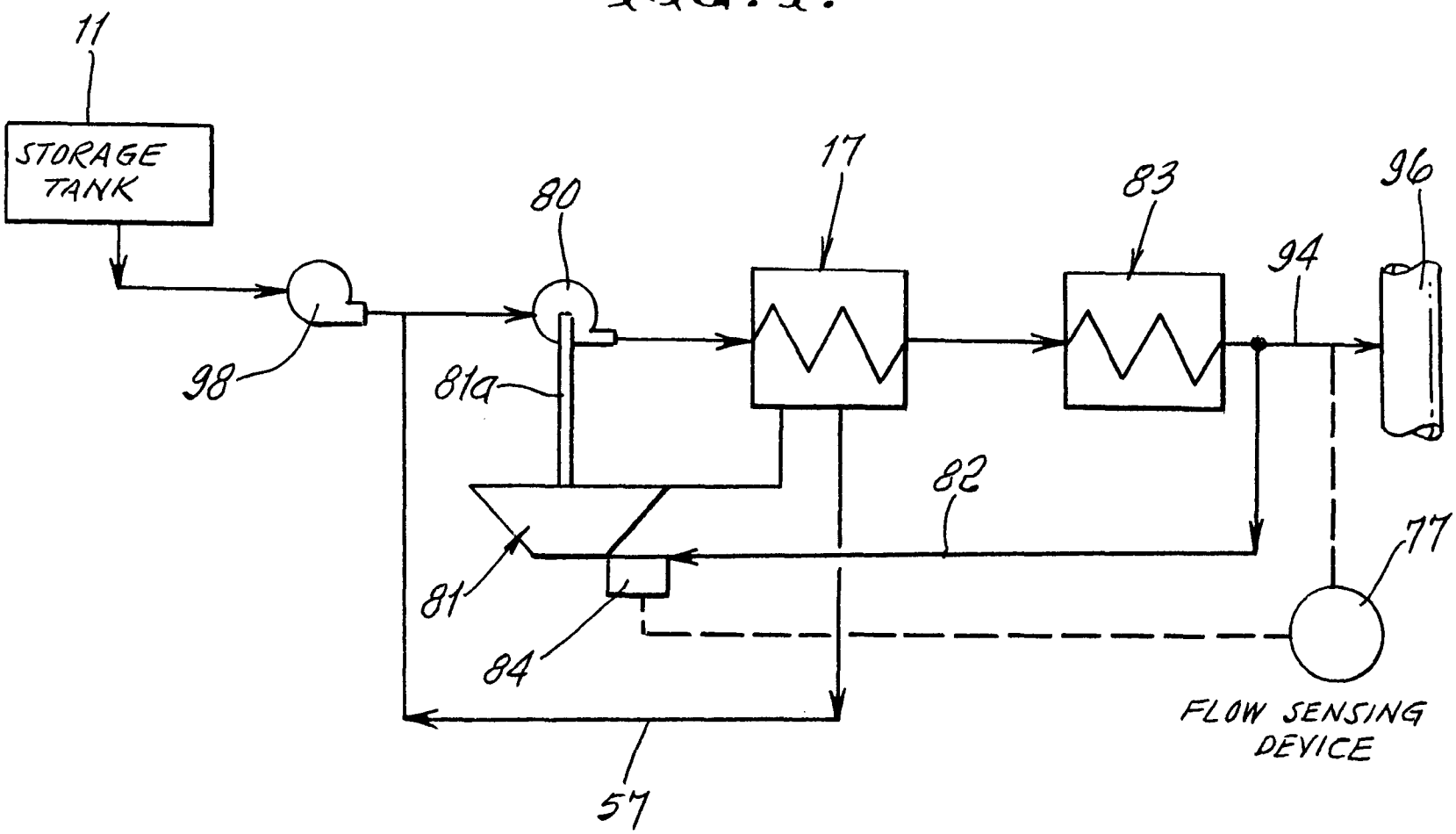
FIG. 4 is a diagram showing an additional form of the invention.
Figure 9A:
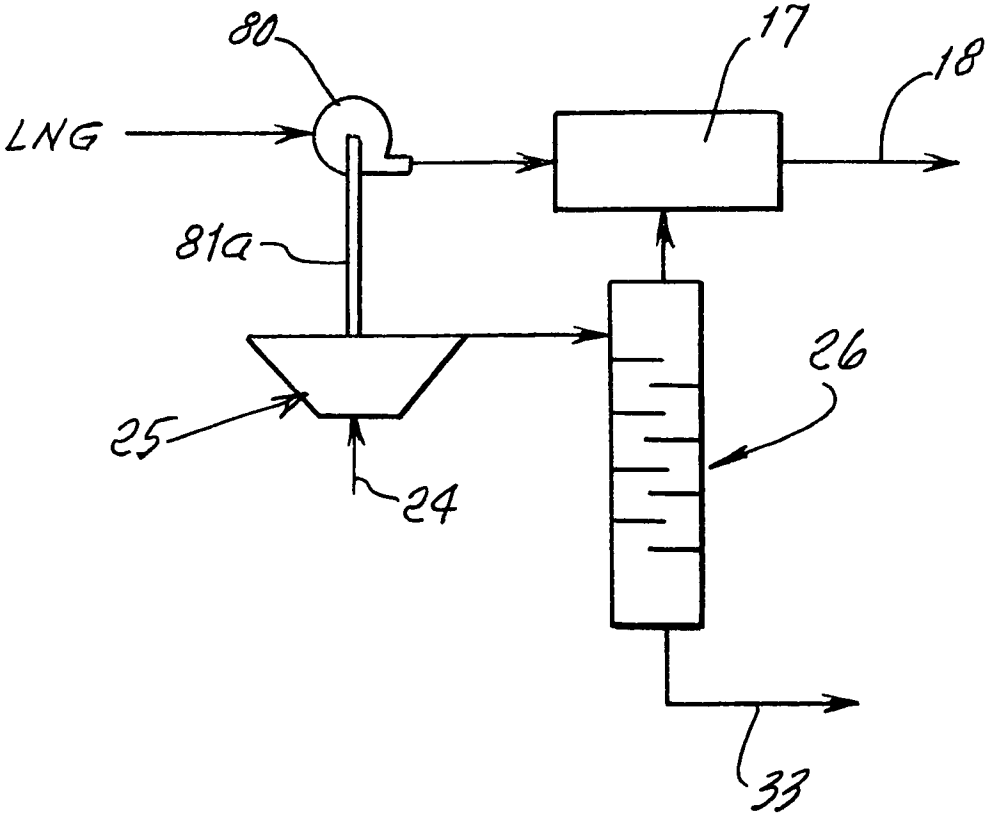

Referring to FIG. 4 main pumping at 80 of LNG is directly driven from the output shaft 81*a* of the expansion turbine 81, as shown. Turbine 81 corresponds to turbine 17 in FIG. 1 and receives a slip stream 82 of gas from the discharge side of the LNG vaporizer 83.

Pump speed (RPM) is controlled or regulated as shown, as by control of the turbine nozzles 84 (variable flow area) as a function of flow rate of vaporizer discharge at 94 to the commercial pipeline 96. See the flow sensing device indicated at 77, sensing flow at 94 and controlling the nozzles, to increase nozzle openings in respond to reduced flow sensing, to maintain desired flow rate. An electric boost pump 98 boosts flow pressure to inlet of pump 80. Condensate from 17 flows at 57 back to the inlet side of pump 80.

In summary, Liquefied Natural Gas (LNG) is transported by ship to receiving terminals where it is unloaded into large low temperature tanks and stored at near atmospheric pressure. The LNG is then pumped to pressures between 70 and 80 bara, heated in a send out vaporizer to near atmospheric temperatures and injected into a pipeline for distribution to users. Normally the send out pumps are powered by electric motors. The power required by these pumps represents a significant power demand.

This FIG. 4 aspect of the invention relates to a method of making the send-pumping operation "self-powered" or nearly so. Electric powered boost pump 98 operates to elevate the pressure to about 170 psia, and the second high speed turbine powered main pump 80 completes the pumping to about 1440 psia. The pumped liquid is then delivered to the heat exchanger/condenser 17 where it is heated (several degrees) by condensing natural gas.

Next the LNG is heated to near atmospheric temperature by the send out vaporizer 83. The send-out vaporizer may employ a variety of heat sources such as natural gas combustion, co-generation waste heated, sea water or ambient air. Before the warm natural gas is injected into the pipeline, a small slip stream (about 10 to 15% of the total flow) is diverted at 82 to supply the expansion turbine 81. In the turbine the gas is expanded down to about 170 psia where it is fed into the condenser/heat exchanger. All of the vapor is condensed and exits the heat exchanger as a liquid and is blended with the liquid between the two pumps.

Pipelines typically have multiple sources of supply, which requires each of them to have controls to regulate the amount of gas injected into the pipeline. By equipping the expansion turbine with adjustable inlet nozzles the speed of the turbine/ high speed pump is regulated, which in turn permits flow control as measured by the flow sensing device.

The boost pump represents the only power draw in the system and its power draw is very low (less than 12% of the pumping power demand). The separate pump 98 provides the Net Positive Suction pressure required to prevent the high speed send out pump 80 from cavitating. Pump 98 could be powered by the turbine, but it needs to turn at low speed to prevent it from cavitating, and would require a gear box between the high speed turbine 81 and the low speed pump 98.

The process described above may be combined with the use of a distillation column as in FIG. 1, where it is also desired to produce a vehicle grade LNG.

FIG. 4*a* shows turbine 25 direct drive at 81*a*. Pump 80 operates to pump refrigerated source LNG to a heat exchanger/condenser, and with a distillation column 26 receiving turbine exhaust for distillation and supply to the heat exchanger/condenser, the elements connected in a loop, as shown.

We claim:

1. A process of treating refrigerated heating grade source LNG to form engine fuel grade LNG, which includes the steps a) providing a distillation column operating to distil a stream of said refrigerated source LNG to form purified distillate, b) providing a heat exchanger/condenser, c) passing said purified distillate in heat exchange relation with said refrigerated source LNG in the heat exchanger/condenser to condense the distillate thereby forming condensate which constitutes said engine fuel grade LNG, d) providing a first vaporizer, and pumping said stream of said refrigerated source LNG through the said heat exchanger/condenser, for supply to the first vaporizer, e) operating said first vaporizer to produce a first stream of heating grade natural gas for commercial distribution, f) providing and operating an expansion turbine to which the first stream of heating grade natural gas from the first vaporizer is supplied, and from which expanded natural gas is directly supplied to said distillation column, g) passing a reflux portion of said condensate to said distillation column at an upper level therein, a second portion of the condensate bring directed for use as said engine fuel grade LNG, h) providing a second vaporizer and removing bottoms formed in said distillation column, and subjecting said bottoms to vaporization in the second vaporizer to produce heating grade natural gas in a second stream, i) combining said first and second streams of heating grade natural gas, for distribution by directing the second stream from the second vaporizer directly into the first stream produced by the first vaporizer for combination therewith after and downstream from removal of said first stream from the first vaporizer.

2. The process of claim 1 wherein said refrigerated source LNG is removed in a refrigerated state from a transport vessel.

* * * * *